US011507007B2

(12) United States Patent
Takahashi et al.

(10) Patent No.: US 11,507,007 B2
(45) Date of Patent: Nov. 22, 2022

(54) GLOSSINESS INSPECTION DEVICE, GLOSSINESS INSPECTION METHOD, AND IMAGE FORMING APPARATUS

(71) Applicant: KONICA MINOLTA, INC., Tokyo (JP)

(72) Inventors: Atsushi Takahashi, Akishima (JP); Hitoshi Asano, Toyokawa (JP); Yumiko Izumiya, Hachioji (JP); Hirotada Seki, Toyokawa (JP); Akimasa Ishikawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/347,178

(22) Filed: Jun. 14, 2021

(65) Prior Publication Data

US 2022/0011703 A1 Jan. 13, 2022

(30) Foreign Application Priority Data

Jul. 10, 2020 (JP) ..... JP2020-119272

(51) Int. Cl.
*G03G 15/00* (2006.01)

(52) U.S. Cl.
CPC ..... *G03G 15/5029* (2013.01); *G03G 15/5041* (2013.01); *G03G 15/5062* (2013.01);
(Continued)

(58) Field of Classification Search
CPC ..... G03G 15/5029; G03G 15/6585; G03G 2215/00616; G03G 15/55; G03G 15/5062;
(Continued)

(56) References Cited

U.S. PATENT DOCUMENTS 8,587,844 B2 11/2013 Itoh et al.
9,288,367 B2 3/2016 Hirata et al.
(Continued)

FOREIGN PATENT DOCUMENTS

JP 2012002601 A 1/2012
JP 2015078975 A 4/2015

OTHER PUBLICATIONS

U.S. Appl. No. 17/218,634, First Named Inventor: Akimasa Ishikawa; Title: "Image Forming Device, Gloss Measuring Method, and Program"; filed Mar. 31, 2021.

*Primary Examiner* — Walter L Lindsay, Jr.
*Assistant Examiner* — Laura Roth
(74) *Attorney, Agent, or Firm* — Holtz, Holtz & Volek PC

(57) ABSTRACT

A glossiness inspection device includes an illumination device that emits irradiation light to a glossiness detection target and a light receiving device that receives reflected light of the irradiation light reflected by the glossiness detection target and outputs a light reception detection signal according to an amount of the received light. A dimmer of the device adjusts an amount of the irradiation light, and a detection signal adjuster of the device adjusts a gain for amplifying the light reception detection signal. An irradiation position controller of the device selectively irradiates a first gloss region and a second gloss region of a correction plate with the irradiation light. A hardware processor of the device adjusts at least one of the amount of the irradiation light, an offset of the detection signal adjuster, a characteristic straight line for calculating a glossiness, or a calculated glossiness.

5 Claims, 9 Drawing Sheets

(52) U.S. Cl.
CPC ..... *G03G 15/6585* (2013.01); *G03G 2215/00616* (2013.01); *G03G 2215/00805* (2013.01)

(58) Field of Classification Search
CPC . G03G 2215/0081; G03G 2215/00611; G03G 2215/00042; G03G 15/043; G03G 2215/00755; G03G 2215/00805; G03G 15/5041
See application file for complete search history.

(56) References Cited

U.S. PATENT DOCUMENTS

2011/0304862 A1* 12/2011 Itoh ..... B41F 33/0036 358/1.9
2015/0078767 A1* 3/2015 Momma ..... G03G 15/2032 399/33

* cited by examiner

GLOSSINESS INSPECTION DEVICE, GLOSSINESS INSPECTION METHOD, AND IMAGE FORMING APPARATUS

The entire disclosure of Japanese patent Application No. 2020-119272, filed on Jul. 10, 2020, is incorporated herein by reference in its entirety.

BACKGROUND

Technological Field

The present invention relates to a glossiness inspection device, a glossiness inspection method, and an image forming apparatus.

Description of the Related Art

In recent years, there has been an increasing demand for higher image quality in a multi-function peripheral (MFP). One of requirements for higher image quality is the in-plane stability and the temporal stability of a glossiness of a toner image.

As a gloss inspection method, there is a method of receiving reflected light of a subject by using an optical element, an area image sensor, or the like, and detecting the glossiness by a difference in the amount of received light.

As one of such inspection methods, JP 2015-78975 A proposes a method of determining the glossiness by using a plurality of light sources and making a comparison with a reference patch. Furthermore, JP 2012-2601 A proposes a method of removing a diffusion component by use of a plurality of illumination systems and inspecting a gloss distribution of an image.

Incidentally, in a conventional inspection device for inspecting the glossiness, a circuit is calibrated by use of an output of reflected light from a reference correction plate having a high glossiness, and thus the calibration accuracy is not sufficient.

In addition, the sensitivity for inspecting the glossiness may be changed in order to discriminate a minute gloss difference generated in an image after fixing. In such a case, a gain of an amplifier that amplifies a light receiving signal is changed. Due to an offset generated by this gain change, false detection of the gloss may occur.

SUMMARY

The present invention has been made in consideration of the above points, and provides a glossiness inspection device, a glossiness inspection method, and an image forming apparatus capable of inspecting a glossiness with high accuracy even when the sensitivity for inspecting the glossiness is changed.

To achieve the abovementioned object, according to an aspect of the present invention, a glossiness inspection device reflecting one aspect of the present invention comprises: an illumination device that emits irradiation light; a light receiving device that receives reflected light of the irradiation light reflected by a glossiness detection target and outputs a light reception detection signal according to an amount of the received light; a correction plate that includes at least a first gloss region having a first glossiness and a second gloss region having a second glossiness lower than the first glossiness; a dimmer that adjusts an amount of the irradiation light; a detection signal adjuster that adjusts a gain for amplifying the light reception detection signal; an irradiation position controller that selectively irradiates the first gloss region and the second gloss region with the irradiation light; and a hardware processor that adjusts at least one of the amount of the irradiation light, an offset of the detection signal adjuster, a characteristic straight line for calculating a glossiness, or a calculated glossiness based on a level of a detection signal output from the detection signal adjuster when the gain of the detection signal adjuster is changed.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Overall Configuration of Image Forming Apparatus

Figure 1:
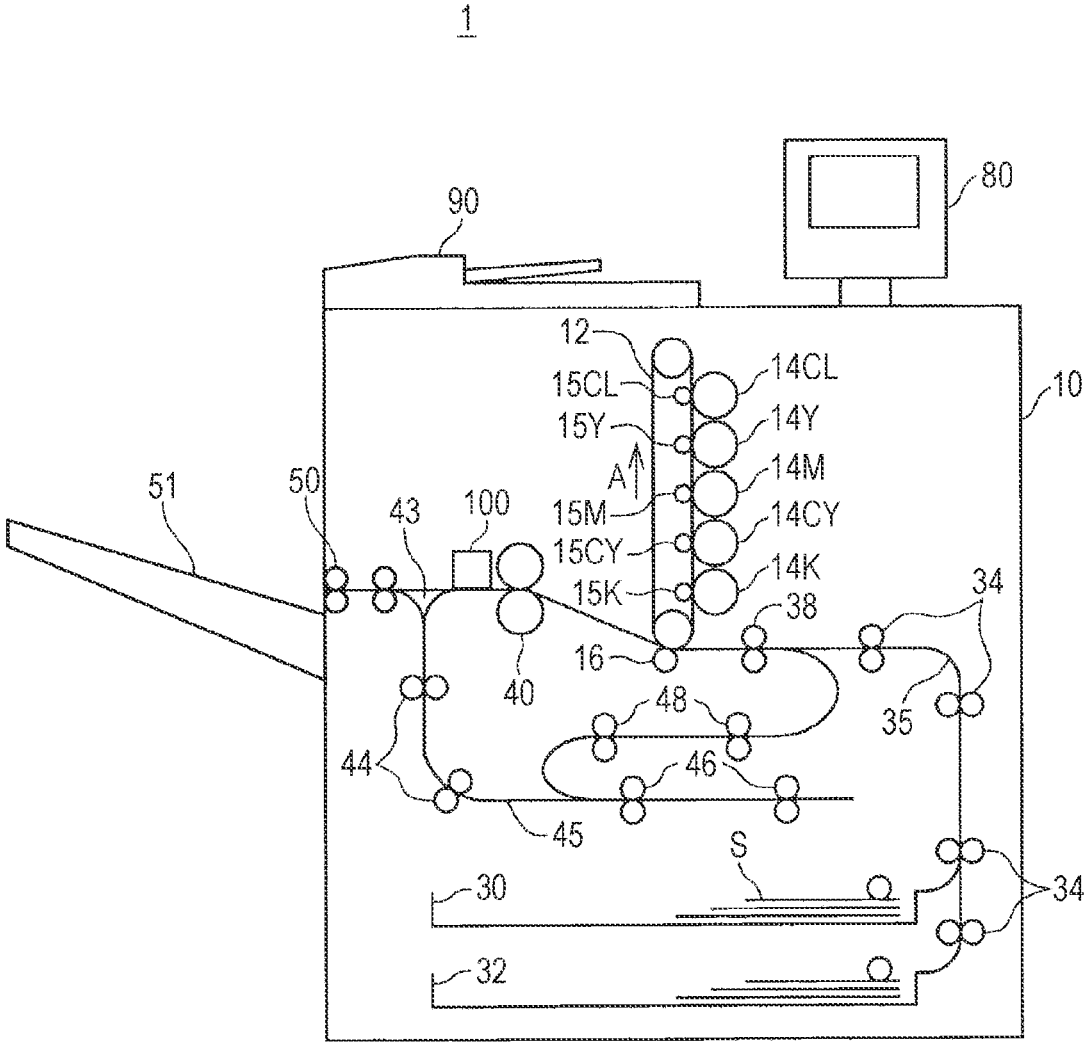
FIG. 1 is a schematic view illustrating a configuration example of an image forming apparatus according to an embodiment.

FIG. 1 is a schematic view illustrating a configuration example of an image forming apparatus to which the present invention is applied. An image forming apparatus 1 includes a printer 10, an operation panel 80, and a document reading unit 90. A sheet S on which an image is printed by the printer 10 is sent to a sheet ejection tray 51 via a sheet ejection roller 50.

The printer 10 prints the image on the sheet based on image data. The operation panel 80 accepts operations from a user, such as starting printing and selecting a printing mode (double-sided printing mode, high-gloss mode, and the like). The document reading unit 90 reads a document and generates the image data.

An intermediate transfer belt 12 is arranged on the printer 10. The intermediate transfer belt 12 is rotationally driven in a direction of an arrow A. A toner image formed on each of surfaces of photoconductor drums is primarily transferred onto the intermediate transfer belt 12. The toner image that has been primarily transferred onto the intermediate transfer belt 12 is secondarily transferred to the sheet S.

On a side surface of the intermediate transfer belt 12, five image forming units 14CL, 14Y, 14M, 14CY, and 14K (hereinafter, the reference signs are simplified and the image forming units are indicated by a reference sign 14) are arranged in the order of clear (CL), yellow (Y), magenta (M), cyan (C), and black (K) colors from the top. Each of the image forming units 14 includes a photoconductor drum (not illustrated). Around each photoconductor drum, a charger that uniformly charges the surface of the photoconductor drum, an exposer that forms an electrostatic latent image according to the image data on the uniformly charged surface of the photoconductor drum, and a developer that develops the electrostatic latent image into a toner image are arranged (neither is illustrated).

In addition, primary transfer rollers 15CL, 15Y, 15M, 15CY, and 15K (hereinafter, the reference signs are simplified and the primacy transfer rollers are indicated by a reference sign 15) are arranged at positions facing the corresponding photoconductor drums with the intermediate transfer belt 12 interposed therebetween. Each of the primary transfer rollers 15 electrostatically attracts the toner image formed on the surface of the corresponding photoconductor drum and primarily transfers the toner image onto the intermediate transfer belt 12.

A secondary transfer roller 16 is arranged below the intermediate transfer belt 12. The secondary transfer roller 16 secondarily transfers the toner image formed on the intermediate transfer belt 12 onto the transported sheet S.

A fixing unit 40 that fixes the transferred toner image onto the sheet S is arranged on a downstream side of the secondary transfer roller 16. The sheet ejection roller 50 is provided on the further downstream side of the fixing unit 40. A switching gate 43 is provided between the fixing unit 40 and the sheet ejection roller 50.

Sheet feed cassettes 30 and 32 are detachably arranged in a lower part of the printer 10. Furthermore, a transport path 35 is formed from the sheet feed cassettes 30 and 32 to the sheet ejection tray 51 via an intermediate transport roller 34, a resist roller 38, the secondary transfer roller 16, the fixing unit 40, and the sheet ejection roller 50. Each of the above rollers and the transport path 35 constitute a non-reverse transport portion. In this embodiment, the non-reverse transport portion is constituted by a straight transport portion, and a transport portion from an image former to the downstream side in a sheet ejection direction is constituted by the non-reverse transport portion.

Furthermore, on an upper side of the sheet feed cassettes 30 and 32, a reverse transport path 45 is provided that branches off from the transport path 35 on the downstream side of the fixing unit 40 via the switching gate 43 and joins the transport path 35 immediately before the resist roller 38 located on an upstream side of the image former in a sheet transport direction.

On the downstream side of the reverse transport path 45, an ADU reverse roller 46 and an ADU intermediate transport roller 48 are provided that reverse the front and back of the sheet S and transport the sheet S to the downstream side of the reverse transport path 45.

In addition, on the reverse transport path 45 located directly below the transport path 35 from the fixing unit 40 to the sheet ejection roller 50, a transport/reverse roller 44 is arranged that reverses the front and back of the sheet S transported from the fixing unit 40 and transports the sheet S to a side of the sheet ejection roller 50, and a part of the reverse transport path 45 joins the transport path 35 on the downstream side.

In addition to this configuration, the image forming apparatus 1 includes a glossiness inspection unit 100. The glossiness inspection unit 100 is arranged between the fixing unit 40 and the sheet ejection roller 50. The glossiness inspection unit 100 is provided to detect a glossiness of the sheet S on which the toner image is formed.

Configuration of Glossiness Inspection Unit 100

Figure 2:
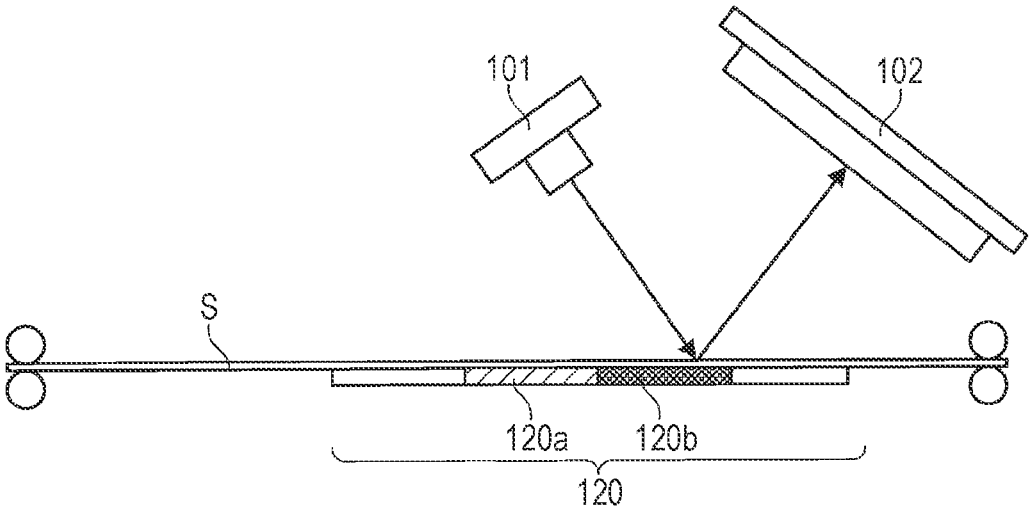
FIG. 2 is a diagram for describing a principle of glossiness detection by a glossiness inspection unit.

FIG. 2 is a diagram for describing a principle of glossiness detection by the glossiness inspection unit 100.

The glossiness inspection unit 100 includes an illumination device 101 and a reflected light receiving device 102, irradiates, with light from the illumination device 101, a toner fixing surface of the sheet S after toner fixing, and receives reflected light by the reflected light receiving device 102 to detect the glossiness based on the amount of received light.

Furthermore, the glossiness inspection unit 100 includes a shading correction plate 120, and uses the shading correction plate 120 to correct parameters and the like in obtaining the glossiness.

The shading correction plate 120 is provided on a lower surface side of the sheet S. As a result, in a case where the sheet S is present at an irradiation position of the illumination device 101, the light from the illumination device 101 is applied to the sheet S, and the reflected light is incident on the reflected light receiving device 102. On the other hand, in a case where the sheet S is not present at the irradiation position of the illumination device 101, the light from the illumination device 101 is applied to the shading correction plate 120, and the reflected light is incident on the reflected light receiving device 102.

The case where the sheet S is not present at the irradiation position is before the start of printing, after the start of printing, or between the sheets S at the time of printing. That is, the correction using the shading correction plate 120 is performed before the start of printing, after the start of printing, or between the sheets S at the time of printing.

Note that, in the example illustrated in FIG. 2, the shading correction plate 120 is arranged on the lower surface side of the sheet S, but the shading correction plate 120 may be arranged on an upper surface side of the sheet S. In this case, the shading correction plate 120 is moved to the irradiation position of the illumination device 101 before the start of printing or after the start of printing, for example, so that the correction is performed by use of the shading correction plate 120, and when the gloss is inspected at the time of printing, the shading correction plate 120 is retracted from the irradiation position.

In short, the shading correction plate 120 is only required to be arranged at the irradiation position of the illumination device 101 at the time of correction.

The shading correction plate 120 includes at least a high gloss region 120*a* and a low gloss region 120*b*. Here, it is preferable that a glossiness of the high gloss region 120*a* is equal to or higher than the maximum glossiness of an expected inspection target, and a glossiness of the low gloss region is equal to or lower than the minimum glossiness of the expected inspection target. For example, the high gloss region 120*a* has a glossiness of 100%, and the low gloss region 120*b* has a glossiness of 0%.

The shading correction plate 120 can be made of, for example, glass, plastic, paper, or the like. In a case where the shading correction plate 120 is made of glass, a predetermined glossiness can be obtained by a surface roughness being changed, for example. Specifically, the rougher the surface, the lower the glossiness.

Figure 3:
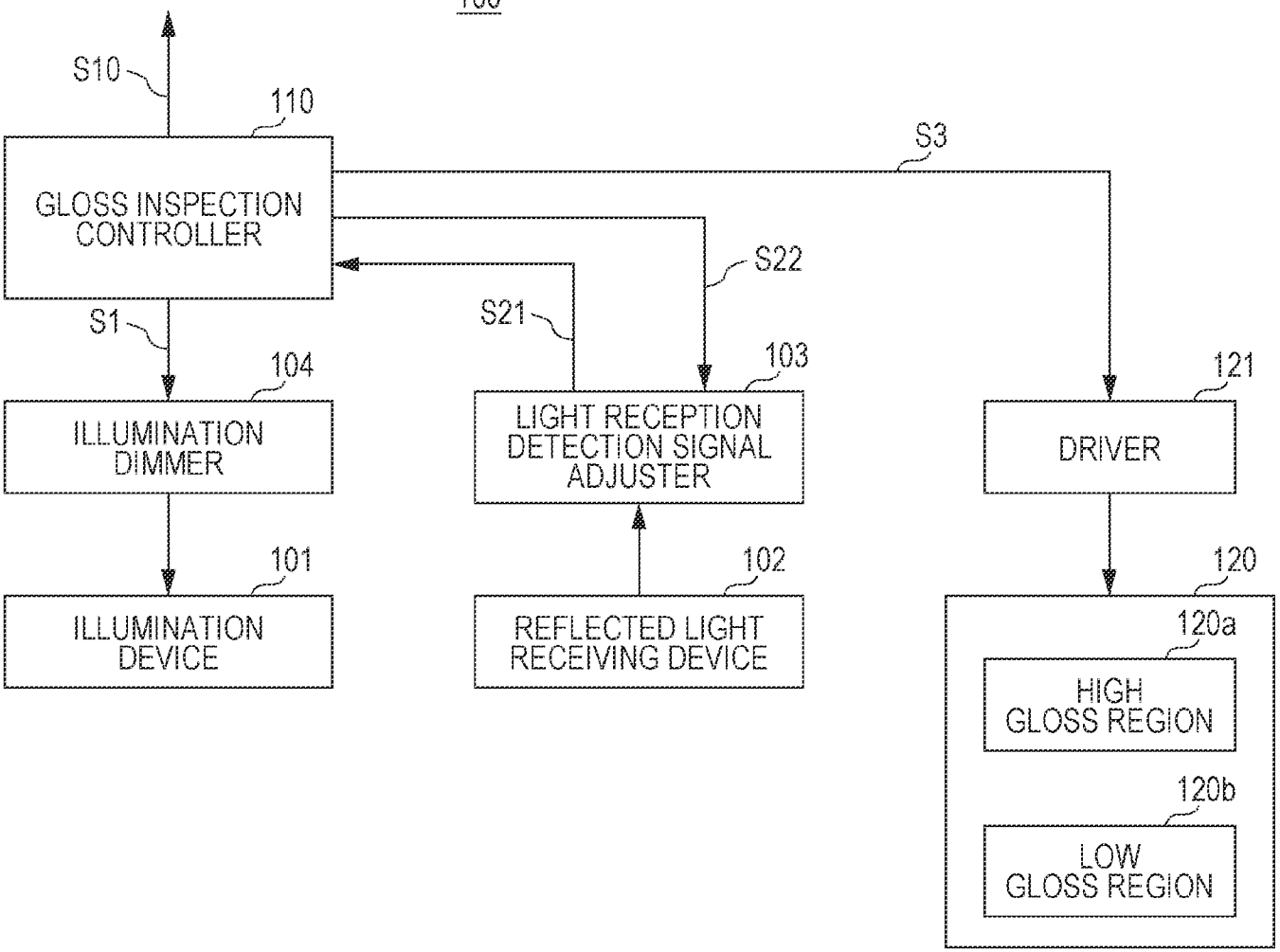
FIG. 3 is a block diagram illustrating a schematic configuration of the glossiness inspection unit.

FIG. 3 is a block diagram illustrating a schematic configuration of the glossiness inspection unit 100.

The illumination device 101 is configured by using, for example, a light emitting diode (LED) or xenon.

An illumination dimmer 104 controls the amount of emitted light of the illumination device 101 by supplying the illumination device 101 with a drive voltage and an input current corresponding to an illumination control signal S1 from a gloss inspection controller 110. For example, the illumination dimmer 104 supplies the illumination device 101 with a pulse width modulation (PWM) voltage corresponding to the illumination control signal S1.

The reflected light receiving device 102 is configured by using, for example, a photodiode, a phototransistor, a linear sensor, an area sensor, or the like, and outputs a signal according to the amount of received light. The output signal of the reflected light receiving device 102 is input to a light reception detection signal adjuster 103.

The light reception detection signal adjuster 103 is a so-called amplifier, is configured by using, for example, an operational amplifier, and has a configuration in which an amplification factor (gain) and an offset can be changed.

The light reception detection signal adjuster 103 receives input of a signal S22 for setting the amplification factor and the offset (hereinafter referred to as a setting signal S22) from the gloss inspection controller 110, and sets the amplification factor and the offset based on the setting signal S22. The light reception detection signal adjuster 103 amplifies and offsets the signal input from the reflected light receiving device 102 with the set amplification factor and offset, and outputs the amplified and offset signal as a detection signal S21 to the gloss inspection controller 110.

Figure 5A:
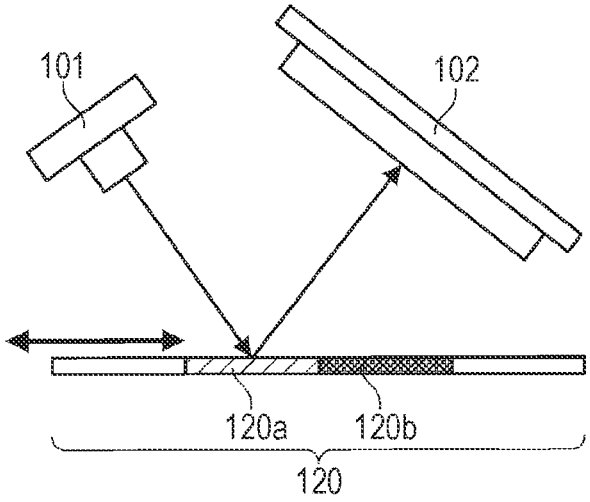
FIG. 5A is a diagram illustrating a state in which a high gloss region is illuminated by an illumination device and reflected light is received by a reflected light receiving device.
Figure 5B:
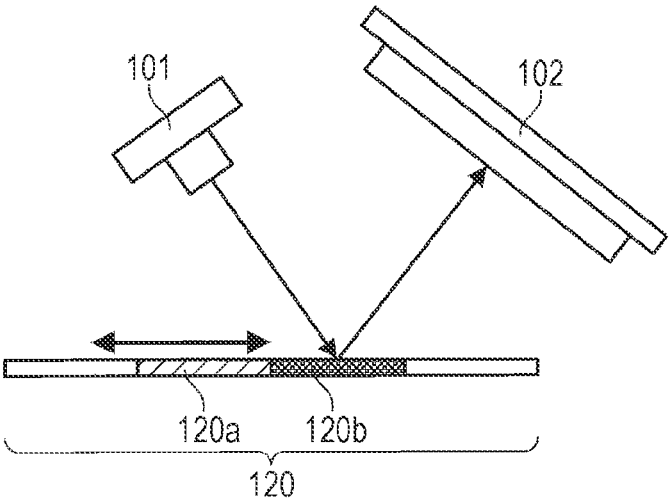
FIG. 5B is a diagram illustrating a state in which a low gloss region is illuminated by the illumination device and reflected light is received by the reflected light receiving device.

A driver 121 is configured by using, for example, a motor or a solenoid, and moves the shading correction plate 120 based on a drive control signal S3 from the gloss inspection controller 110. Specifically, as illustrated in FIGS. 5A and 5B, the driver 121 can move the shading correction plate 120 to at least a position where the high gloss region 120*a* is illuminated by the illumination device 101 and the reflected light can be received by the reflected light receiving device 102 (FIG. 5A) and a position where the low gloss region 120*b* is illuminated by the illumination device 101 and the reflected light can be received by the reflected light receiving device 102 (FIG. 5B).

As described above, the gloss inspection controller 110 has a function of calculating a glossiness S10 based on the detection signal S21 output from the light reception detection signal adjuster 103, in addition to a function of controlling the amount of irradiation light of the illumination device 101, a function of amplifying and offsetting the reflected light detection signal, and a function of controlling the movement of the shading correction plate 120. The calculated glossiness S10 is output to a controller (not illustrated) or the like of the image forming apparatus 1.

Figure 4:
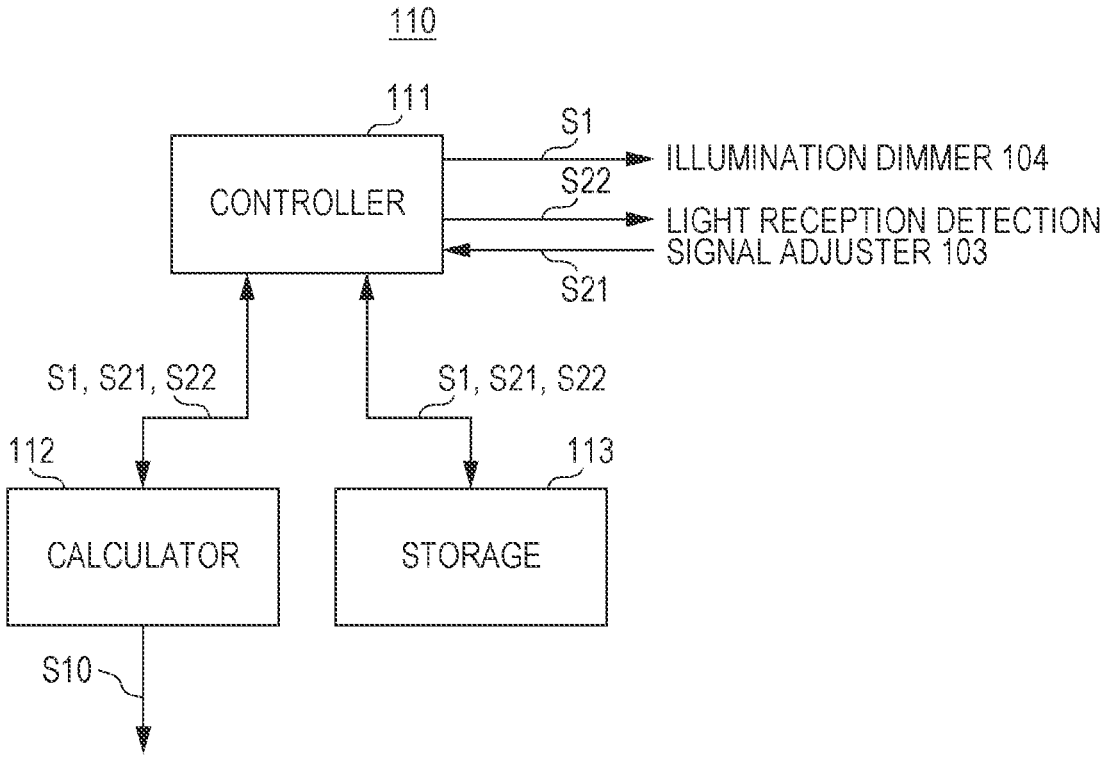
FIG. 4 is a block diagram illustrating a configuration of a gloss inspection controller.

FIG. 4 is a block diagram illustrating a configuration example of the gloss inspection controller 110. Note that the gloss inspection controller 110 includes, for example, a central processing unit (CPU) as a processor, a storage medium such as a read only memory (ROM) that stores a control program, a working memory such as a random access memory (RAM), and a communication circuit, which are not illustrated. A function of each part to be described below is implemented by the CPU executing the control program.

The gloss inspection controller 110 includes a controller 111, a calculator 112, and a storage 113. The controller 111 outputs the illumination control signal S1 to the illumination dimmer 104, outputs the setting signal S22 to the light reception detection signal adjuster 103, and receives the input of the detection signal S21 from the light reception detection signal adjuster 103.

The storage 113 stores the illumination control signal S1, the setting signal S22, and the detection signal S21.

The calculator 112 calculates, for example, the glossiness S10 by using the illumination control signal S1, the setting signal S22, and the detection signal S21.

Operation of Glossiness Inspection Unit 100

Figure 6:
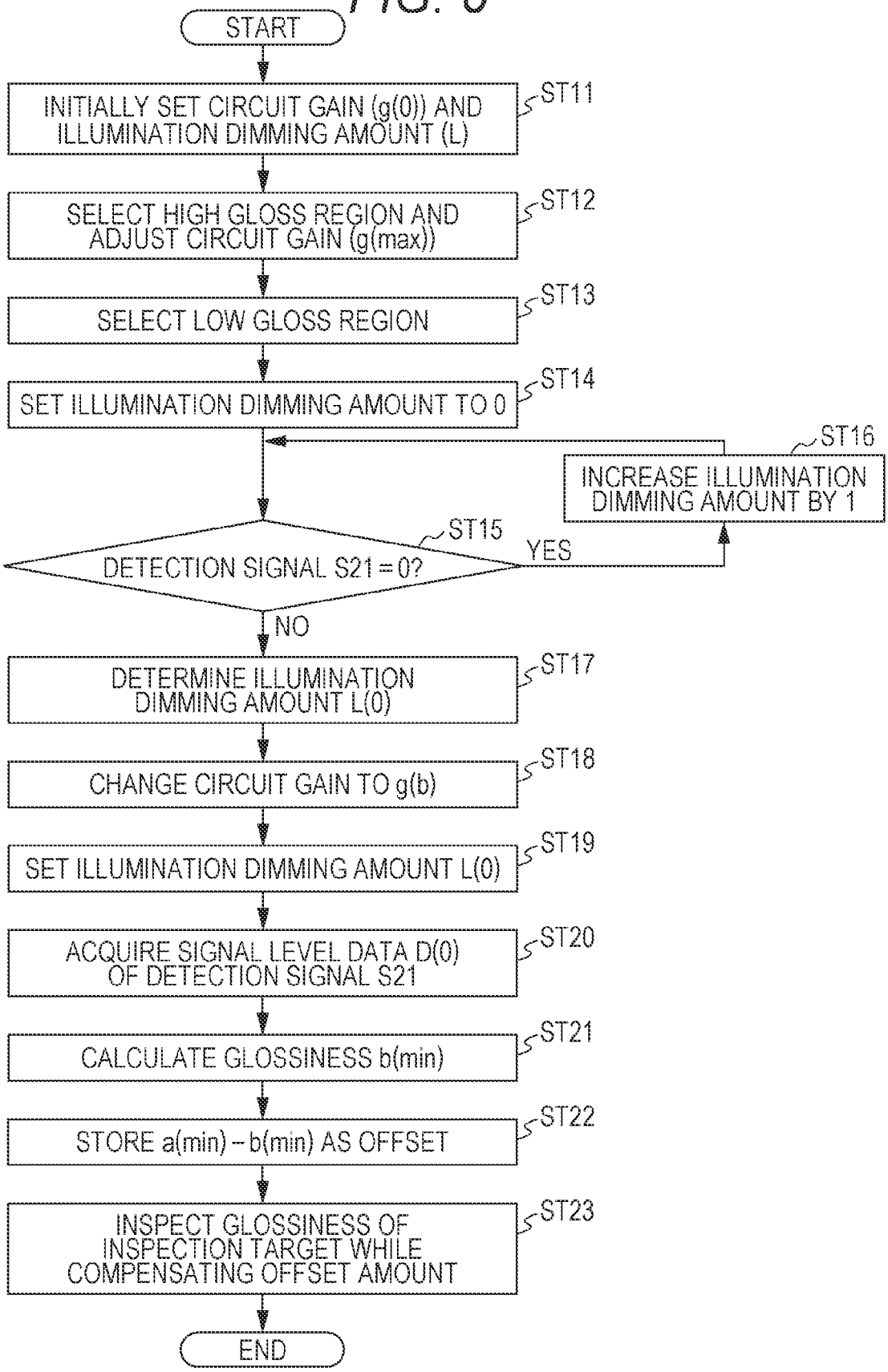
FIG. 6 is a flowchart for describing an operation of the glossiness inspection unit.
Figure 7:
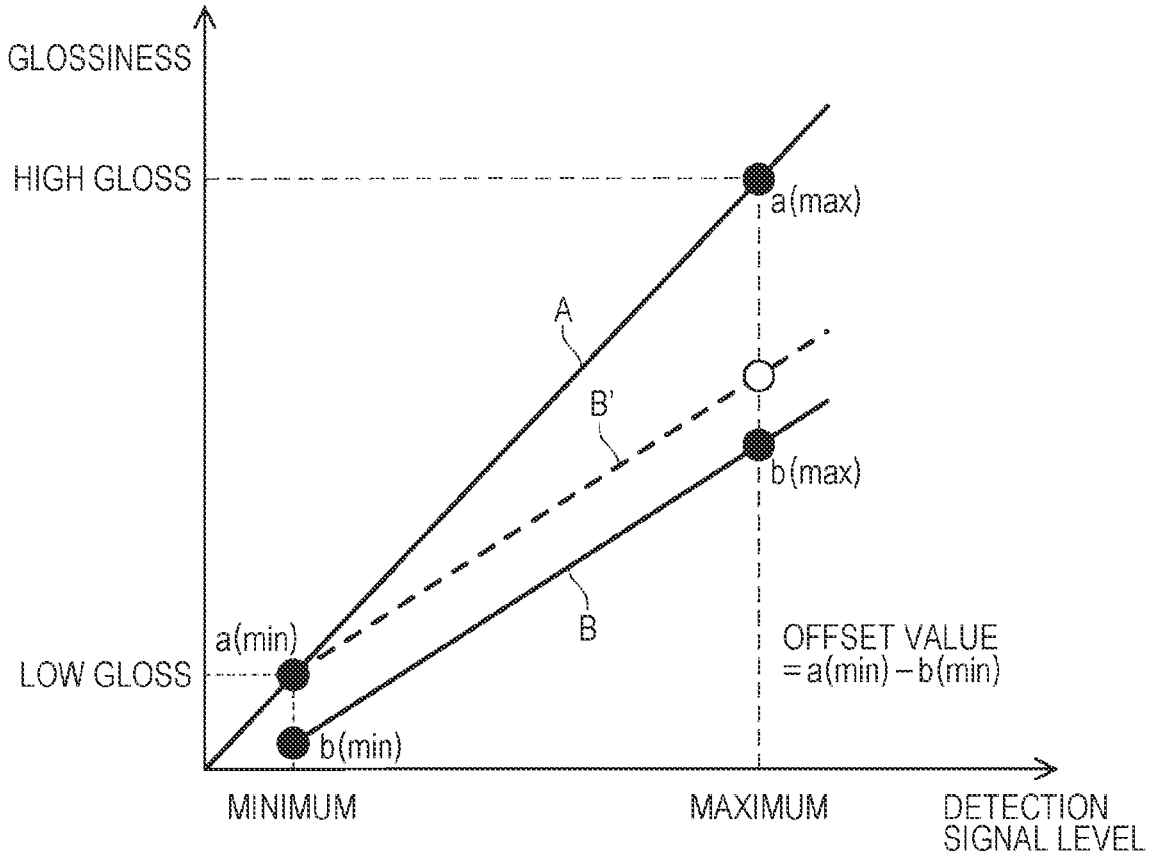
FIG. 7 is a diagram illustrating a relationship between a glossiness and a signal level of a detection signal output from a light reception detection signal adjuster.

Next, an operation of the glossiness inspection unit 100 will be described with reference to FIGS. 6 and 7. FIG. 6 is a flowchart for describing the operation of the glossiness inspection unit 100. FIG. 7 is a diagram illustrating a relationship between the glossiness and a signal level of the detection signal S21 output from the light reception detection signal adjuster 103.

The glossiness inspection unit 100 first adjusts the illumination and the light reception by using the shading correction plate 120 before inspecting a glossiness of the toner image formed on the sheet S. This operation will be described in detail below.

In step ST11, a circuit gain (that is, amplification factor) of the light reception detection signal adjuster 103 is initially set to g(0), and an illumination dimming amount of the illumination dimmer 104 is initially set to L.

Next, in step ST12, the high gloss region 120*a* is selected and the circuit gain is adjusted to g(max). That is, the shading correction plate 120 is moved so that the high gloss region 120*a* is located at the irradiation position of the irradiation light, and the gain (amplification factor) of the light reception detection signal adjuster 103 is set to g(max). As a result, the circuit gain g(max) passing through a point a(max) in FIG. 7 can be obtained. In addition, a characteristic straight line A indicating the relationship between the detection signal level and the glossiness in FIG. 7 can be estimated.

Next, in step ST13, the low gloss region 120*b* is selected. That is, the shading correction plate 120 is moved so that the low gloss region 120*b* is located at the irradiation position of the irradiation light. Next, in step ST14, the illumination dimming amount is set to 0. Next, in step ST15, it is determined whether the level of the detection signal S21 is 0 (that is, whether the detection signal S21 is output), and if the detection signal S21 is 0, the processing proceeds to step ST16, and the illumination dimming amount is increased by a unit amount ("1" in the example in FIG. 6). As described above, the amount of irradiation light is increased until a negative result is obtained in step ST15 (that is, until the detection signal S21 is output).

When the detection signal S21 is output, the processing proceeds from step ST15 to step ST17, and an illumination dimming amount L(0) is determined in step ST17. It can be said that this illumination dimming amount L(0) is the minimum irradiation light amount at which the gloss of the low gloss region 120*b* can be detected.

Next, in step ST18, the circuit gain (that is, amplification factor) of the light reception detection signal adjuster 103 is changed to g(b). Next, in step ST19, the illumination dimming amount is set to L(0) and the low gloss region 120*b* is irradiated with light.

Here, changing the circuit gain of the light reception detection signal adjuster 103 corresponds to changing the slope of the characteristic straight line in FIG. 7. If the circuit gain is increased, the slope of the characteristic straight line becomes smaller and the sensitivity for detecting the glossiness increases. On the contrary, if the circuit gain is decreased, the slope of the characteristic straight line becomes larger and the sensitivity for detecting the glossiness decreases. In practice, in the case of inspecting the glossiness of the toner image, it is common practice to change the circuit gain to change the sensitivity.

However, when the circuit gain of the light reception detection signal adjuster 103 is changed, a circuit offset is generated accordingly. If the glossiness is calculated based on the detection signal S21 without considering this circuit offset, the calculated glossiness includes an error corresponding to the circuit offset.

This will be described with reference to FIG. 7. A dotted straight line B' in FIG. 7 is a characteristic straight line in a case where there is no offset. However, in reality, when the circuit gain is changed, the characteristic straight line becomes like a solid straight line B in the FIG. 7. That is, an offset is generated.

Therefore, in the present embodiment, first, in step ST20, signal level data D(0) of the detection signal S21 (that is, detection signal level data corresponding to a point b(min) on the solid straight line B in FIG. 7) is acquired. Next, in step ST21, a glossiness b(min) is calculated from the signal level data D(0) and the solid straight line B. Next, in step ST22, a(min)-b(min) is stored as an offset at the time of gain switching.

The processing up to this point is preprocessing for inspecting the glossiness of the toner image. When this preprocessing is completed, the glossiness inspection unit 100 inspects, in step ST23, the glossiness of the toner image to be inspected while compensating an offset amount. Specifically, the controller 111 adjusts at least one of the amount of irradiation light, the offset of the light reception detection signal adjuster 103, the characteristic straight line for calculating the glossiness (straight line B), or the calculated glossiness so that the offset amount is compensated.

As a result, even when the gain of the light reception detection signal adjuster 103 is switched, an adverse effect due to the offset generated by the gain can be suppressed, and an accurate glossiness inspection can be achieved.

Effect

As described above, the glossiness inspection unit 100 of the present embodiment includes the illumination device 101 that emits irradiation light, the light receiving device 102 that receives reflected light of the irradiation light reflected by a glossiness detection target and outputs a light reception detection signal according to an amount of the received light, the correction plate 120 that includes at least the first gloss region 120*a* having a first glossiness and the second gloss region 120*b* having a second glossiness lower than the first glossiness, the dimmer 104 that adjusts an amount of the irradiation light, the detection signal adjuster 103 that adjusts a gain for amplifying the light reception detection signal, the irradiation position controller (driver 121) that selectively irradiates the first gloss region 120*a* and the second gloss region 120*b* with the irradiation light, and the gloss inspection controller 110 that adjusts at least one of the amount of the irradiation light, an offset of the detection signal adjuster 103, a characteristic straight line for calculating a glossiness, or a calculated glossiness based on a level of a detection signal output from the detection signal adjuster 103 when the gain of the detection signal adjuster 103 is changed.

As a result, even when the gain of the light reception detection signal adjuster 103 is switched, an adverse effect due to the offset generated by the gain can be suppressed, and an accurate glossiness inspection can be achieved.

Furthermore, the gloss inspection controller 110 of the glossiness inspection unit 100 of the present embodiment performs following processes (i) to (iii).

(i) The gloss inspection controller 110 measures, as a reference light amount, the minimum irradiation light amount L(0) at which a detection signal can be output from the detection signal adjuster 103 when the second gloss region 120*b* is irradiated with the irradiation light with the gain of the detection signal adjuster 103 initially set to a first value.

(ii) The gloss inspection controller 110 detects, as an offset, a difference between the second glossiness a(min), which is known, and the glossiness b(min) calculated based on a level of a detection signal output from the detection signal adjuster 103 when the second gloss region 120*b* is irradiated with the reference light amount L(0) of the irradiation light with the gain of the detection signal adjuster 103 switched from the first value to a second value larger than the first value.

(iii) The gloss inspection controller 110 adjusts, based on the detected offset, at least one of the amount of the irradiation light, the offset of the detection signal adjuster 103, the characteristic straight line for calculating the glossiness, or the calculated glossiness after the gain is switched from the first value to the second value.

As a result, it is possible to accurately obtain the offset generated when the gain of the light reception detection signal adjuster 103 is switched, and thus an accurate glossiness inspection can be achieved.

Other Embodiments

The above-described embodiment shows merely an example of embodiment in carrying out the present invention, and the technical scope of the present invention should not be interpreted in a limited manner by this embodiment. That is, the present invention can be carried out in various forms without departing from its gist or its main features.

In another embodiment, following processes (iv) and (v) may be added in addition to the above-described processes (i) to (iii).

Figure 8:
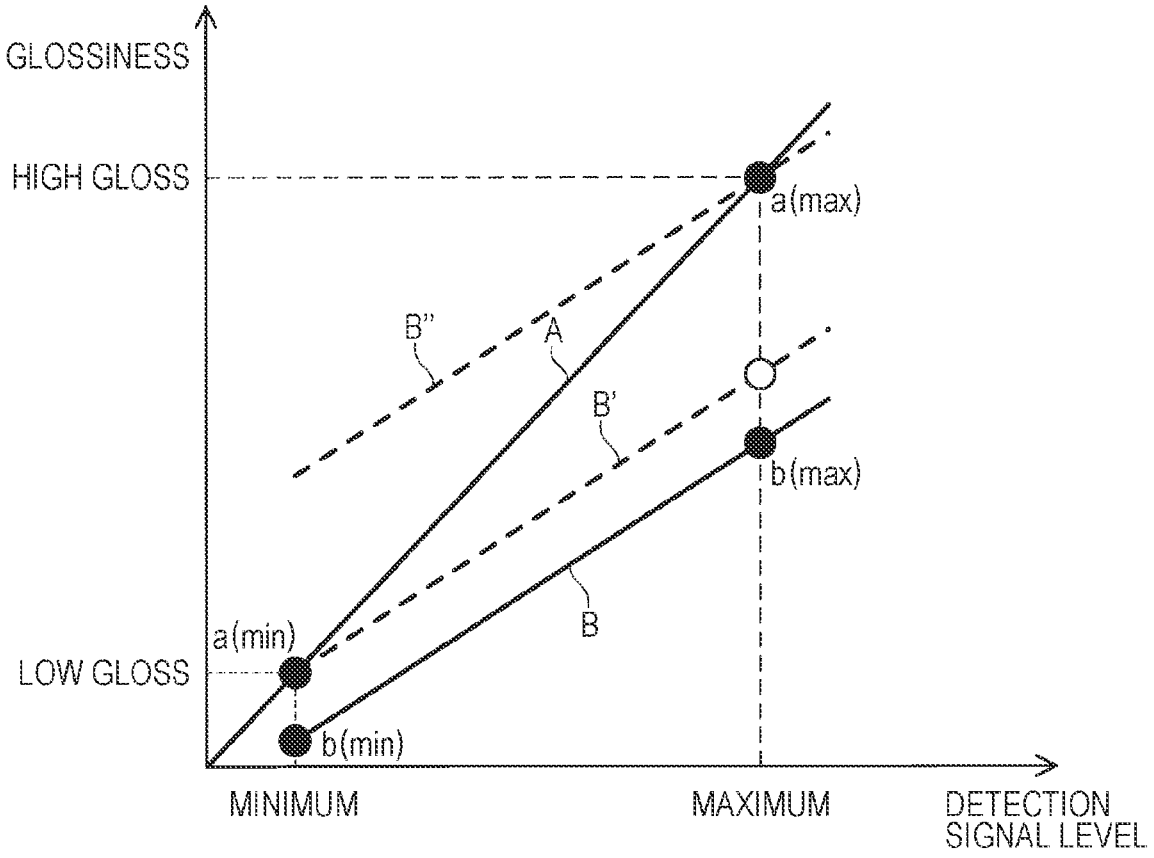
FIG. 8 is a diagram illustrating the relationship between the glossiness and the signal level of the detection signal output from the light reception detection signal adjuster.

(iv) The gloss inspection controller 110 reduces, when the first gloss region 120*a* is irradiated with the irradiation light with the gain of the detection signal adjuster 103 set to the second value, the amount of the irradiation light until a detection signal corresponding to the first glossiness a(max) is output from the detection signal adjuster 103. According to this process, an inspection using a characteristic straight line B" in FIG. 8 is possible.

(v) The gloss inspection controller 110 uses the reduced amount of the irradiation light when a detection target with a high glossiness is inspected.

That is, there is a possibility that the inspection in the high gloss region cannot be performed only by the above-described processes (i) to (iii), but when the process of reducing the amount of light is performed as in (iv), it is also possible to perform the gloss inspection in the high gloss region, or improve the accuracy of the gloss inspection in the high gloss region.

Figure 9:
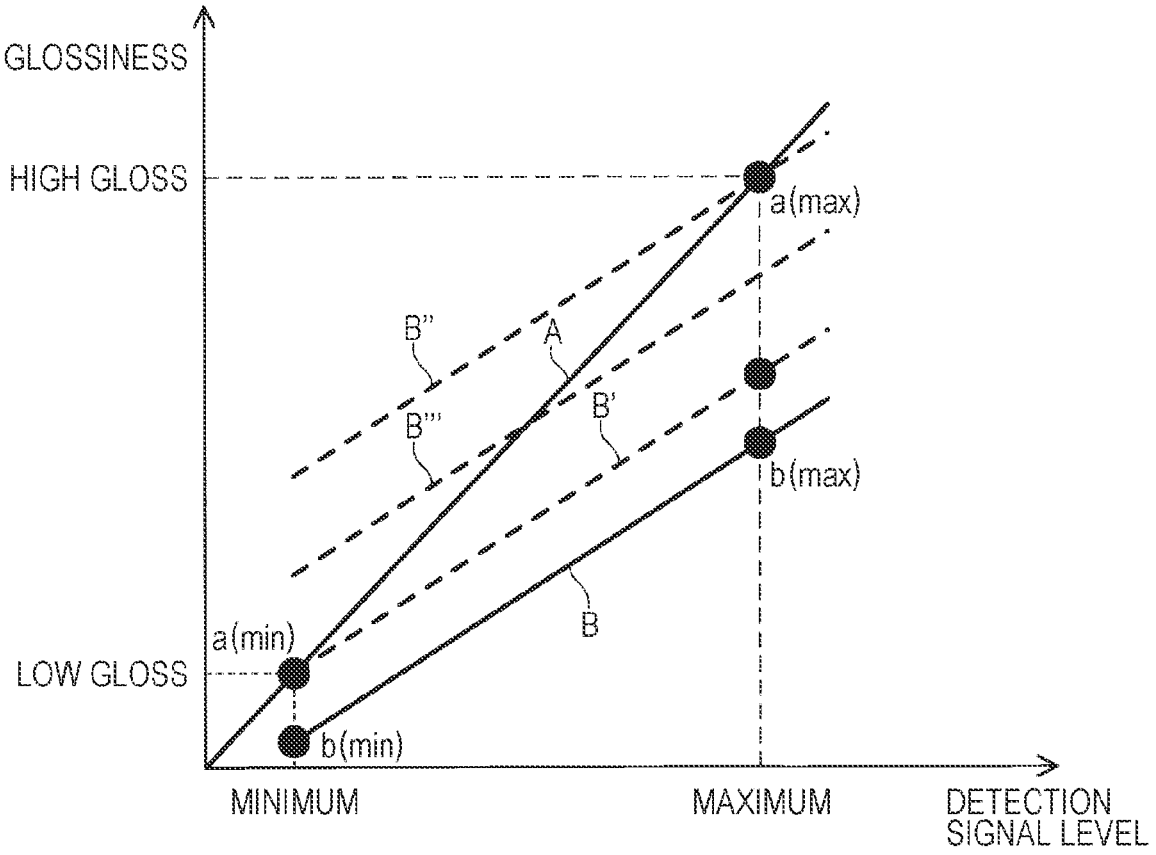
FIG. 9 is a diagram illustrating the relationship between the glossiness and the signal level of the detection signal output from the light reception detection signal adjuster.

Furthermore, in another embodiment, in addition to the processes (i) to (v), the amount of irradiation light may be lower than in the case of (i) to (iii) and higher than in the case of (iv) and (v). By such an operation, it is possible to perform an inspection using a characteristic straight line B''' in an intermediate region as illustrated in FIG. 9, and it is possible to inspect a wider range of gloss with high accuracy.

In the above-described embodiments, a case where the glossiness inspection device and the glossiness inspection method of the present disclosure are applied to the glossiness inspection of the toner image has been described, but the glossiness inspection device and the glossiness inspection method of the present disclosure are not limited to this, and can be applied to a case of detecting a glossiness of an object other than the toner image.

The present invention is suitable for a glossiness inspection device capable of changing the sensitivity for detecting a glossiness.

Although embodiments of the present invention have been described and illustrated in detail, the disclosed embodiments are made for purposes of illustration and example only and not limitation. The scope of the present invention should be interpreted by terms of the appended claims.

What is claimed is:

1. A glossiness inspection device comprising:

an illumination device that emits irradiation light;

a light receiving device that receives reflected light of the irradiation light reflected by a glossiness detection target and outputs a light reception detection signal according to an amount of the received light;

a correction plate that includes at least a first gloss region having a first glossiness and a second gloss region having a second glossiness lower than the first glossiness;

a dimmer that adjusts an amount of the irradiation light;

a detection signal adjuster that adjusts a gain for amplifying the light reception detection signal;

an irradiation position controller that selectively irradiates the first gloss region and the second gloss region with the irradiation light; and a hardware processor that adjusts, in accordance with the gain of the detection signal adjuster, at least one of the amount of the irradiation light, an offset of the detection signal adjuster, a characteristic straight line for calculating a glossiness, or a calculated glossiness based on an offset that is generated when the gain of the detection signal adjuster is changed and that is calculated based on a level of a detection signal output from the detection signal adjuster when the gain of the detection signal adjuster is changed.

2. The glossiness inspection device according to claim 1, wherein the hardware processor (i) measures, as a reference light amount, a minimum irradiation light amount at which a detection signal can be output from the detection signal adjuster when the second gloss region is irradiated with the irradiation light with the gain of the detection signal adjuster initially set to a first value, (ii) detects, as the offset, a difference between the second glossiness, which is known, and a glossiness calculated based on a level of a detection signal output from the detection signal adjuster when the second gloss region is irradiated with the reference light amount of the irradiation light with the gain of the detection signal adjuster switched from the first value to a second value larger than the first value, and (iii) adjusts, based on the detected offset, at least one of the amount of the irradiation light, the offset of the detection signal adjuster, the characteristic straight line for calculating the glossiness, or the calculated glossiness after the gain is switched from the first value to the second value.

3. The glossiness inspection device according to claim 2, wherein in addition to the (i) to (iii), the hardware processor (iv) reduces, when the first gloss region is irradiated with the irradiation light with the gain of the detection signal adjuster set to the second value, the amount of the irradiation light until a detection signal corresponding to the first glossiness is output from the detection signal adjuster, and (v) uses the reduced amount of the irradiation light when a detection target with a high glossiness is inspected.

4. An image forming apparatus comprising:

an image former that forms a toner image on a sheet;

a fixer that fixes the toner image; and the glossiness inspection device according to claim 1, which inspects a glossiness of the fixed toner image.

5. A glossiness inspection method comprising:

emitting irradiation light;

receiving reflected light of the irradiation light reflected by a glossiness detection target and outputting a light reception detection signal according to an amount of the received light;

adjusting an amount of the irradiation light;

amplifying the light reception detection signal by an amplifier;

calculating a glossiness of the glossiness detection target based on the light reception detection signal amplified by the amplifier;

irradiating a correction plate that includes at least a first gloss region having a first glossiness and a second gloss region having a second glossiness lower than the first glossiness, the first gloss region and the second gloss region being selectively irradiated with the irradiation light; and adjusting, in accordance with a gain of the amplifier, at least one of the amount of the irradiation light, an offset of the amplifier, a characteristic straight line for calculating the glossiness, or the calculated glossiness based on an offset that is generated when the gain of the amplifier is changed and that is calculated based on a level of a detection signal output from the amplifier when the gain of the amplifier is changed.

* * * * *